US005469177A

United States Patent [19]

Rush et al.

[11] Patent Number: 5,469,177

[45] Date of Patent: Nov. 21, 1995

[54] ANTENNA ASSEMBLY AND METHOD THEREFOR

[75] Inventors: Tonya A. Rush, Barrington; Steven P. Moehling, Crystal Lake; Kenneth J. Roback, Arlington Heights, all of Ill.

[73] Assignee: Motorola, Inc., Schaumburg, Ill.

[21] Appl. No.: 121,393

[22] Filed: Sep. 15, 1993

[51] Int. Cl.[6] ..... H01Q 1/24

[52] U.S. Cl. ..... 343/702; 343/895; 343/900

[58] Field of Search ..... 343/702, 715, 343/883, 900, 901, 895; H01Q 1/24, 1/36

[56] References Cited

U.S. PATENT DOCUMENTS

| | | | |
|---|---|---|---|
| 4,868,576 | 9/1989 | Johnson, Jr. | 343/702 |
| 5,079,558 | 1/1992 | Koike | 343/702 |
| 5,204,687 | 4/1993 | Elliott et al. | 343/702 |
| 5,258,772 | 11/1993 | Inagana et al. | 343/702 |
| 5,343,213 | 8/1994 | Kottke et al. | 343/702 |

FOREIGN PATENT DOCUMENTS

| | | | |
|---|---|---|---|
| 0245603 | 11/1991 | Japan | 343/702 |

*Primary Examiner*—Donald Hajec
*Assistant Examiner*—Tan Ho
*Attorney, Agent, or Firm*—Randall S. Vaas

[57] ABSTRACT

An antenna assembly for a radio includes an antenna shaft which is translatable between a retracted position and a protracted position. The antenna shaft is translatable through a support tube which is affixed in position with the radio. A detent engages with the antenna shaft to maintain the antenna shaft in either the retracted or the protracted position.

12 Claims, 6 Drawing Sheets

280

100

100

100

280

280

280

280

600

ANTENNA ASSEMBLY AND METHOD THEREFOR

BACKGROUND OF THE INVENTION

The present invention relates generally to antenna apparatus connectable to radio circuitry and, more particularly, to an antenna assembly having an antenna shaft positionable in either of at least two positions.

Antenna apparatus forms a necessary component of a radio device operable either to transmit or to receive (or operable both to transmit and to receive) electromagnetic waves. Portions of such antenna apparatus are typically of physical characteristics dependent, at least in part, upon the frequencies of the electromagnetic waves which are to be transmitted by, or received by, the antenna apparatus.

When the radio device of which the antenna apparatus forms a portion comprises a consumer, electronic device, the antenna apparatus must not only be of physical characteristics to permit proper reception or transmission of the electromagnetic waves, but, further, the antenna apparatus must be of constructions to permit convenient utilization of the radio device of which the antenna apparatus forms a portion.

An example of a consumer-electronic, radio device is a radio transceiver, such as a portable, cellular radiotelephone operable in a cellular communication system. Antenna apparatus forming a portion of such a device is typically translatable into both a retracted position and a protracted position. When in the retracted position, significant portions of the antenna apparatus are typically positioned within the housing of the radio device. When in the protracted position, portions of the antenna apparatus are typically positioned to extend beyond the housing of the radio device. Other radio devices, of course, similarly include antenna apparatus translatable between a retracted and a protracted position. In some constructions of radio devices, including the radio of the preferred embodiment hereinbelow, the radio devices are operable to transmit and to receive electromagnetic waves when the antenna apparatus is positioned to be in either the retracted or the protracted position.

The antenna apparatus forming the portion of the consumer-electronic, radio device must further be of a construction to permit convenient assembly thereof in the radio device in a high-volume assembly process.

SUMMARY OF THE INVENTION

The present invention provides an antenna assembly, and associated method, which is permitting of convenient assembly thereof in a high-volume assembly process.

The present invention further advantageously provides a radio device including an antenna assembly which also permits convenient assembly thereof in a high-volume assembly process.

The present invention includes further advantages and features, the details of which will become more evident by reading the detailed description of the preferred embodiments hereinbelow.

In accordance with the present invention, therefore, an antenna assembly, and associated method, for a radio having radio circuitry is disclosed. The assembly includes an antenna shaft defining a longitudinal axis and having a proximal side portion and a distal side portion. A support tube is positioned about the antenna shaft. The support tube has an inner diameter of dimensions permitting translation of the antenna shaft to permit the support tube to positioned about the proximal side portion of the antenna shaft or, alternately, to permit the support tube to be positioned about the distal side portion of the antenna shaft. A detent is mounted upon the support tube and is engageable alternately with the proximal side portion and the distal side portion of the antenna shaft, thereby to maintain positioning of the proximal side portion of the antenna shaft at the support tube or the distal side portion of the antenna shaft at the support tube, respectively.

BRIEF DESCRIPTION OF THE DRAWINGS

The present invention will be better understood when read in light of the accompanying drawings in which.

BEST MODE FOR CARRYING OUT THE INVENTION

Figure 1:
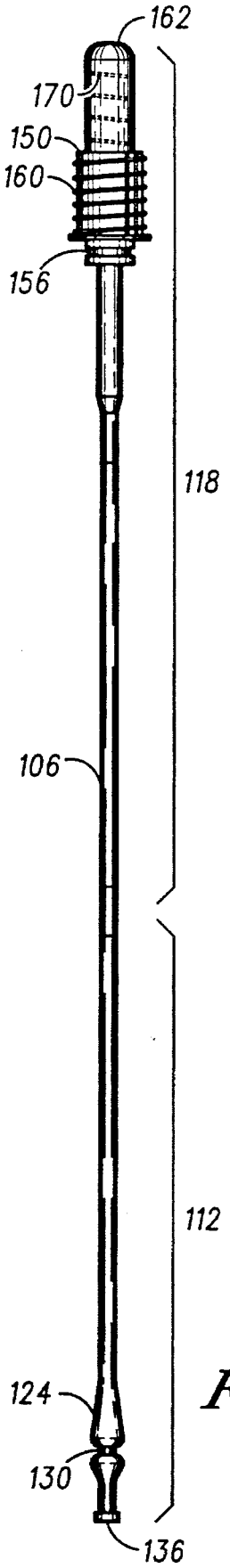
FIG. 1 is a side-elevational view of the antenna assembly of a preferred embodiment of the present invention taken in isolation.

Turning first to the side, elevational view of FIG. 1, an antenna assembly, referred to generally by reference numeral 100, of a preferred embodiment of the present invention is shown. Antenna assembly 100 comprises antenna shaft 106 which is formed of a longitudinally-extending rod member which defines a longitudinal axis along which the antenna shaft 106 extends. Antenna shaft 106 is preferably comprised of a metallic and thermoplastic material. A first portion of antenna shaft 106 encompassed by the bracket pictured at the bottom portion of the Figure shall be referred to as the proximal side portion 112 of the antenna shaft, and the portion of the antenna shaft encompassed by the bracket pictured at the top portion of the Figure shall be referred to as the distal side portion 118 of antenna shaft 106.

Proximal-side portion, tapered mandrel 124 is formed along proximal side portion 112 of antenna shaft 106. Tapered mandrel portion 124 of antenna shaft 106 is of diametral dimensions of gradually-increasing diameters relative to diameters of other portions of antenna shaft 106. Tapered, mandrel portion 124 extends to notch 130 which is of reduced diametral dimensions relative to the diametral dimensions of mandrel portion 124 positioned adjacent thereto. Stop 136 is formed beyond mandrel portion 124 at an end of proximal side portion 112 of antenna shaft.

While hidden from view in FIG. 1, distal side portion 118 of antenna shaft 106 also includes structure analogous to mandrel portion 124, notch 130, and stop 136.

Antenna assembly 100 further comprises support tube 150 positioned about antenna shaft 106 in a manner to permit the antenna shaft to be translated through the support tube. In FIG. 1, support tube 150 is positioned at distal side portion 118 of the antenna shaft.

Detent 156 is mounted upon a portion of support tube 150. As shall be explained hereinbelow, detent 156 is operable alternately to maintain the distal side portion 118 of antenna shaft 106 positioned at support tube 150 (such relative positioning is shown in the view of FIG. 1) or proximal side portion 112 of antenna shaft 106 at support tube 150 (such relative positioning shall be shown in a succeeding Figure).

Antenna winding 160 is supported about support tube 150. The length of winding 160 is dependent, at least in part, upon the frequencies of electromagnetic waves which are to be transmitted by, or received by the antenna assembly.

Cup 162 is positioned at an end of distal side portion 118 of antenna shaft 106. Cup 162 is preferably comprised of a solid casting of material and is of diametral dimensions which permit at least a portion of the cup to be inserted within support tube 150 when antenna shaft 106 is translated to position distal side portion 118 of the antenna shaft at support tube 150. In a preferred embodiment of the present invention, and as illustrated in the Figure, second antenna winding 170 is supported at cup 162.

Figure 2:
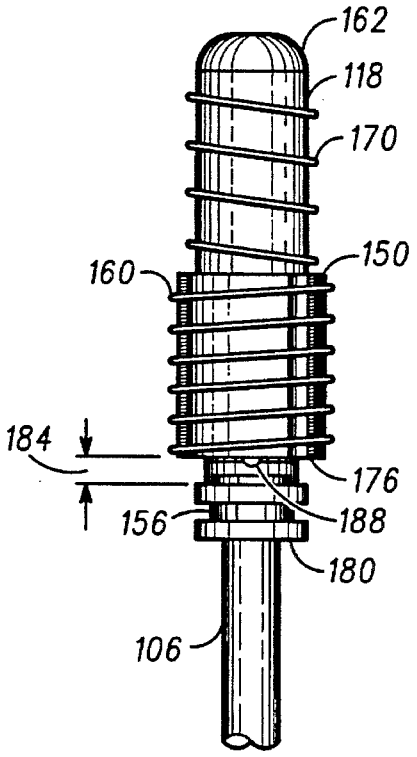
FIG. 2 is an enlarged, cutaway view of a portion of the antenna assembly of FIG. 1.

FIG. 2 is an enlarged, cutaway view of a portion of antenna assembly 100 of FIG. 1. Distal side portion 118 of antenna shaft 106 is again shown to be positioned at support tube 150 such that a portion of cup 162 extends into support tube 150. Antenna winding 160 is further supported about support tube 150. (For purposes of illustration, antenna winding 170 is shown to be positioned about cup 162. However, in a preferred embodiment, and at least particularly for aesthetic reasons, winding 170 is embedded within cup 162.) Windings 160 and 170 are capacitively coupled there together.

The enlarged view of FIG. 2 illustrates that support tube 150 is comprised of a tubular portion having rear wall 176 and detent-support 180 at a location spaced beyond rear wall 176 of support tube 150 by a distance indicated by the distance 184 separating arrows in the Figure. Detent-support 180 is operable to support detent 156 thereat.

Ridge member 188 is further formed upon a bottom surface of rear wall 176 to be positioned between rear wall 176 and a top surface of detent-support 180.

As mentioned previously, antenna shaft 106 is permitted translation through support tube 150 to permit positioning of either proximal side portion 112 or distal side portion 118 of the antenna shaft at support tube 150.

Figure 3:
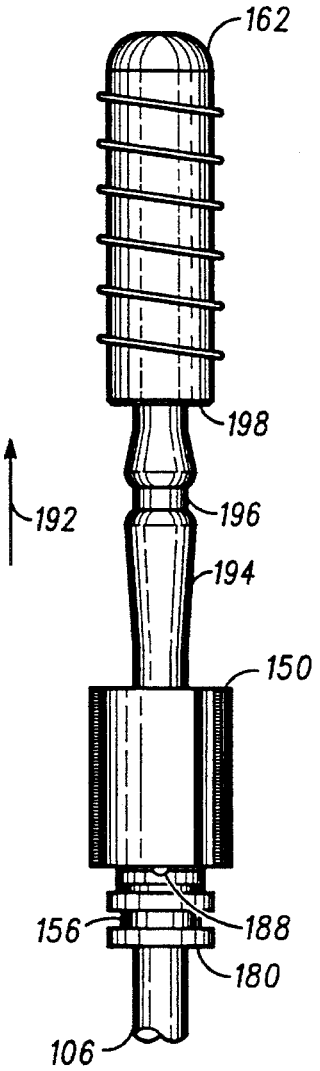
FIG. 3 is an enlarged, cutaway view, similar to that of FIG. 2, but illustrating the relationship between the antenna shaft and the support tube of the antenna assembly of the preferred embodiment of the present invention as the antenna shaft is translated through the support tube.

Turning next to the cutaway view of FIG. 3, an enlarged, cutaway view of antenna assembly 100 is again shown. In the view of FIG. 3, antenna shaft 106 is translated in the direction of arrow 192 such that cup 162 is spaced-apart from support tube 150. The view of FIG. 3 illustrates distal-side, tapered mandrel 194 which, analogous to mandrel 124 formed at proximal side portion 112 (shown in FIG. 1) of antenna shaft 106 is of gradually-increasing diametral dimensions. Distal-side, tapered mandrel 194 extends to notch 196 which is of reduced diametral dimensions relative to the diametral dimensions of mandrel 194 positioned adjacent thereto. The view of FIG. 3 further illustrates a bottom surface of cup 162 which comprises a distal side stop 198. When antenna shaft 106 is translated through support tube 150 as illustrated in FIG. 2, stop 198 abuts against a top surface of rear wall 176 of the tubular portion of support tube 150 to prevent continued translation of antenna shaft 106 through support tube 150.

Figure 4:
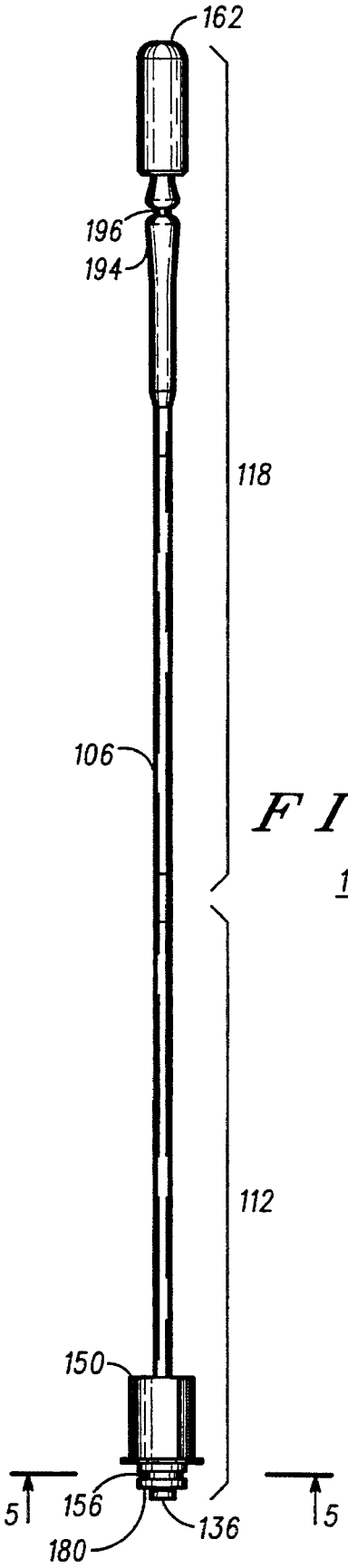
FIG. 4 is a side, elevational view of the antenna assembly of the preferred embodiment of the present invention, similar to that of FIG. 1, but wherein the antenna shaft is translated into a different position relative to the support tube of the antenna assembly of the preferred embodiment of the present invention.

FIG. 4 is a side, elevational view of antenna assembly 100, similar to the view of FIG. 1, but wherein antenna shaft 106 is translated through support tube 150 to position proximal side portion 112 of the antenna shaft at the support tube. As illustrated in the Figure, antenna shaft 106 is translatable through support tube 150 until stop 136 abuts against a bottom surface of detent-support 180 of support tube 150. Further translation of antenna shaft 106 is thereby prohibited.

Detent 156 is operable to engage with either notch 130 (shown in FIG. 1) formed at proximal side portion 112 of antenna shaft 106 or with notch 196 (shown in FIG. 3) formed at distal side portion 118 of the antenna shaft.

Figure 5:
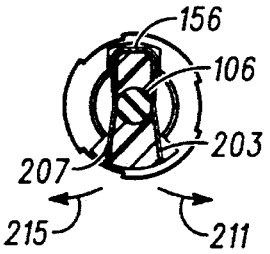
FIG. 5 is a sectional view, taken through line 5—5 of FIG. 4, which illustrates the detent which forms a portion of the antenna assembly of the preferred embodiment of the present invention.

FIG. 5 is a sectional view taken through line 5—5 of FIG. 4 which illustrates detent 156 when engaged with a notch, here notch 130, formed along antenna shaft 106. The sectional view of FIG. 5 illustrates detent 156 to be comprised of a U-shaped, spring clip (i.e., a U-spring) having spring arms 203 and 207. Application of forces in directions indicated by lines 211 and 215 cause outward flexing movement of spring arms 203 and 207, respectively. As antenna shaft 106 is translated through support tube 150 in a first direction, proximal-side, tapered mandrel portion 124 engages with spring arms 203 and 207 of detent 156 to cause flexing of the spring arms.

Continued translation of the antenna shaft in the first direction causes additional flexing of the spring arms 203 and 207 until notch 130 is positioned adjacent to spring arms 203 and 207 of detent 156. When notch 130 is positioned adjacent to the spring arms, expansive forces are not exerted upon the spring arms, and the spring arms 203 and 207 spring back into an unbiased position whereat the spring arms abut against the antenna shaft 106 at notch 130, thereby to maintain the antenna shaft in position thereat.

Upon application of a translation force in a second direction great enough to cause translation of the antenna shaft 106 in a second direction, translation of the antenna shaft 106 is permitted to position the antenna shaft relative to support tube 150 in the arrangement illustrated in FIG. 1. As the antenna shaft is translated through support tube 150, distal-side, tapered mandrel 194 engages with the spring arms 203 and 207 of detent 156, also to cause flexing of the spring arms 203 and 207 until continued translation of antenna shaft 106 in the second direction positions notch 196 at detent 156. Spring arms 203 and 207 of detent 156 spring back into an unbiased position whereat the spring arms abut against the antenna shaft at notch 196. The antenna shaft 106 is thereby again maintained in position thereby.

Figure 6:
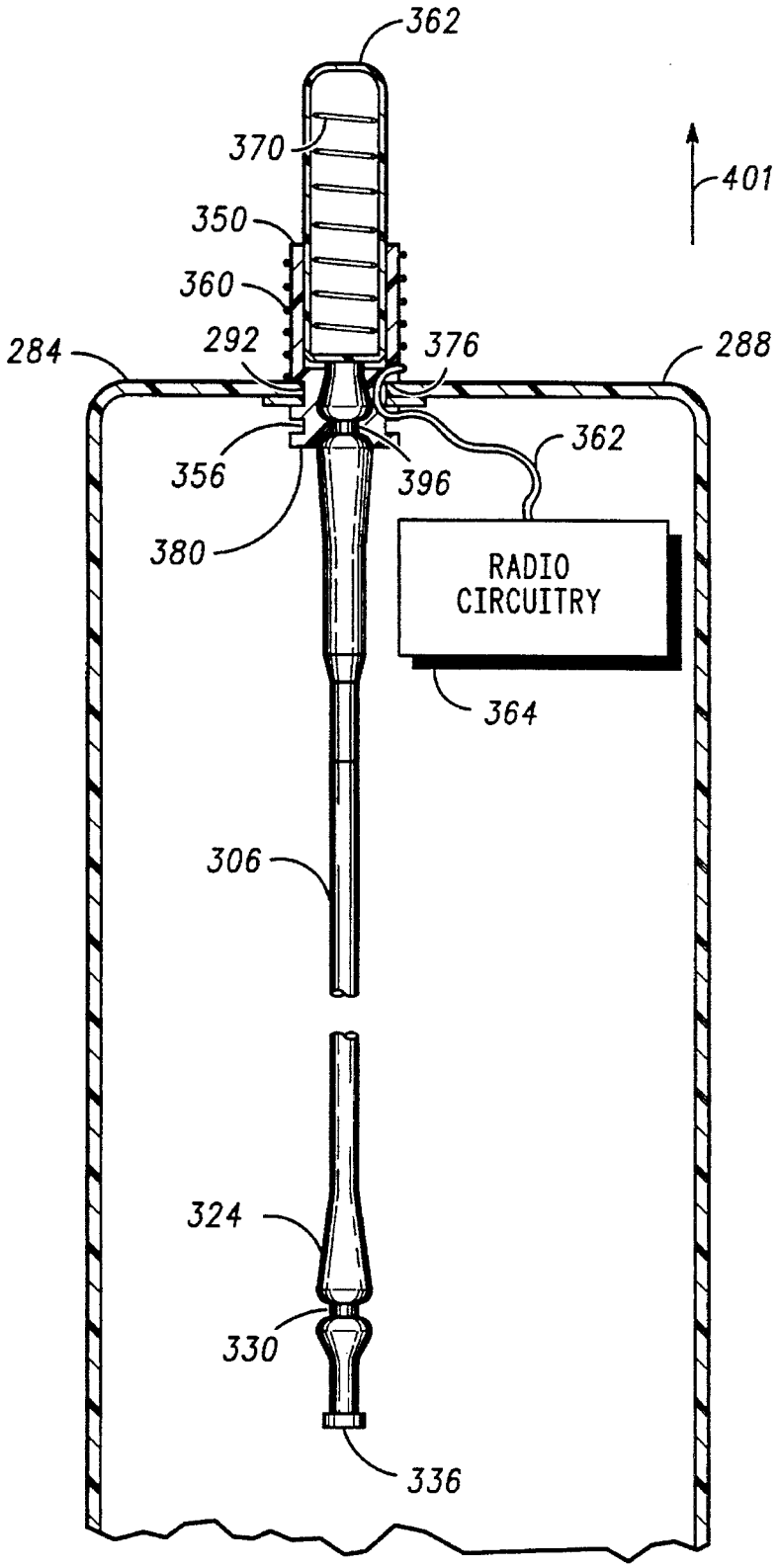
FIG. 6 is a sectional view of a radio transceiver of a preferred embodiment of the present invention which includes the antenna assembly of the preceding figures as a portion thereof.

Turning next to the sectional view of FIG. 6, a radio transceiver, here referred to generally by reference numeral 280, of a preferred embodiment of the present invention is shown. Radio transceiver 280 may, for example, comprise a cellular radiotelephone operable in a cellular communication system.

Radio transceiver 280 includes a housing comprised of front housing portion 284 and rear housing portion 288. Keyhole 292 is formed to extend through front housing portion 284, thereby to permit an antenna assembly, similar to antenna assembly 100 of the preceding Figures, to extend therein. As illustrated, an antenna shaft 306 extends into the supportive enclosure formed of housing portions 284 and 288 of the housing of transceiver 280. Proximal-side, tapered mandrel portion 324 is formed at a proximal side portion of antenna shaft 306 as is also notch 330 and stop 336 in manners analogous to similar such structure formed upon antenna shaft 106 of the preceding Figures.

Support tube 350, analogous to support tube 150 of the preceding Figures, is mounted to front housing portion 284 by insertion of the support tube 350 into keyhole 292. Detent 356, analogous to detent 156 of the preceding Figures, is supported by detent-support 380 and engages with antenna shaft 306 at notch 396 to maintain the antenna shaft 306 in position relative to support tube 350. Antenna shaft 306 of the antenna assembly is sometimes referred to as being in the retracted position when in the position illustrated in FIG. 6.

Translation of antenna shaft 306 in the direction indicated by arrow 401 permits positioning of antenna shaft 306 relative to support tube 350 such that notch 330 abuts against detent 356. The antenna is sometimes referred to as being in the protracted position when the antenna shaft is positioned in such configuration.

Winding 360 supported about support tube 350 includes end portion 362 which extends beyond support tube 350 to permit electrical connection to radio circuitry, indicated in the Figure by block 364. Cup 362 positioned at an end of antenna shaft 306 includes winding 370 which is capacitively coupled to antenna winding 360. While not shown in the Figure, winding 370 may extend along the length of antenna shaft 306 (or concatenated segments of windings may extend along the antenna shaft) to connect capacitively windings 360 and 370 there together when shaft 306 is in the protracted position.

Thereby, merely by inserting the antenna assembly into keyhole 292 of front housing portion 284 to support tube 350 thereat and connecting end portion 662 of winding 360 to radio circuitry 364 housed within the housing of transceiver 280, the antenna assembly may be utilized to transmit or to receive electromagnetic waves. Such procedure facilitates assembly of transceiver 280 in a high-volume assembly process.

The distance separating rear wall 376 of support tube 350 and a top surface of detent-support 380 corresponds to the thickness of front housing portion 284 such that rear wall 376 is positioned at the outer portion of front housing portion 284 and detent-support 380 is positioned at the interior formed of the housing of transceiver 280.

Figure 7:
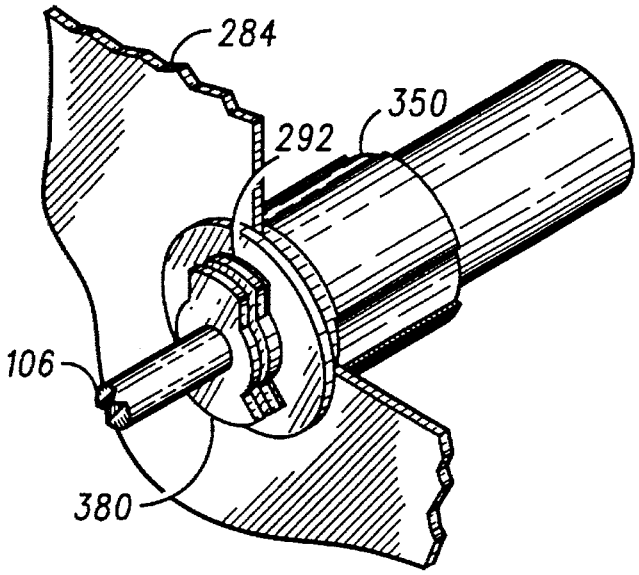
FIG. 7 is a cutaway, perspective view of a portion of the antenna assembly of the preceding figures positioned to form a portion of the radio transceiver of FIG. 6.

FIG. 7 is a cutaway, perspective view of a portion of radio transceiver 280 of FIG. 6. Keyhole 292 of front housing portion 284 is illustrated as is support tube 350 and detent-support 380. The outer diameter of detent-support 380 corresponds to the configuration of keyhole 292 to permit keyed engagement therebetween. By aligning support tube 350 with keyhole 292, and inserting support tube 350 into keyhole 292, detent-support 380 is inserted into the supportive enclosure formed of the housing of radio transceiver 280.

Figure 8:
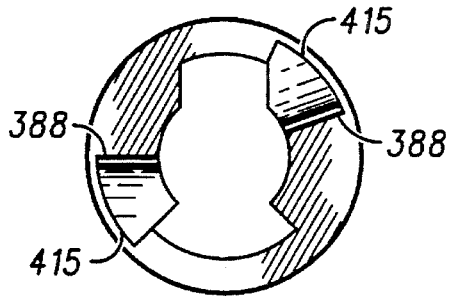
FIG. 8 is a plan view, taken from beneath the support tube shown in the cutaway, perspective view of FIG. 7.

FIG. 8 is a plan view, taken from beneath the support tube 350 of transceiver 280. Ridge members 388 are formed about keyhole 292 of front housing portion 284. And, ramped surfaces 415 are formed upon an inner surface of top housing portion 284. Once support tube 350 is aligned with keyhole 292 to be inserted therethrough, rotation of the support tube 350 causes ridge members 188 formed upon support tube 350 to "ride up" upon ramped surfaces 415 and then snap into position at ridge members 388, thereby to lock the support tube in position thereat.

Figure 9:
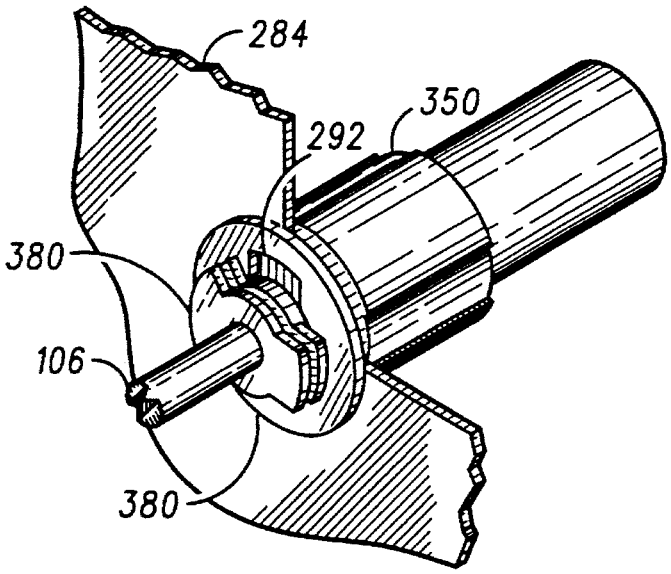
FIG. 9 is a cutaway, perspective view, similar to that of FIG. 7, but which illustrates the antenna assembly rotated into a locked position to be affixed in position thereby.

FIG. 9 is a cutaway, perspective view, similar to that of FIG. 7, but illustrating the relationship between support tube 350 and front housing portion 284 when support tube 350 is rotated into a locked position. When rotated into a locked position, as illustrated, support tube 350 is mounted in a fixed position in affixation to front housing portion 284.

Figure 10:
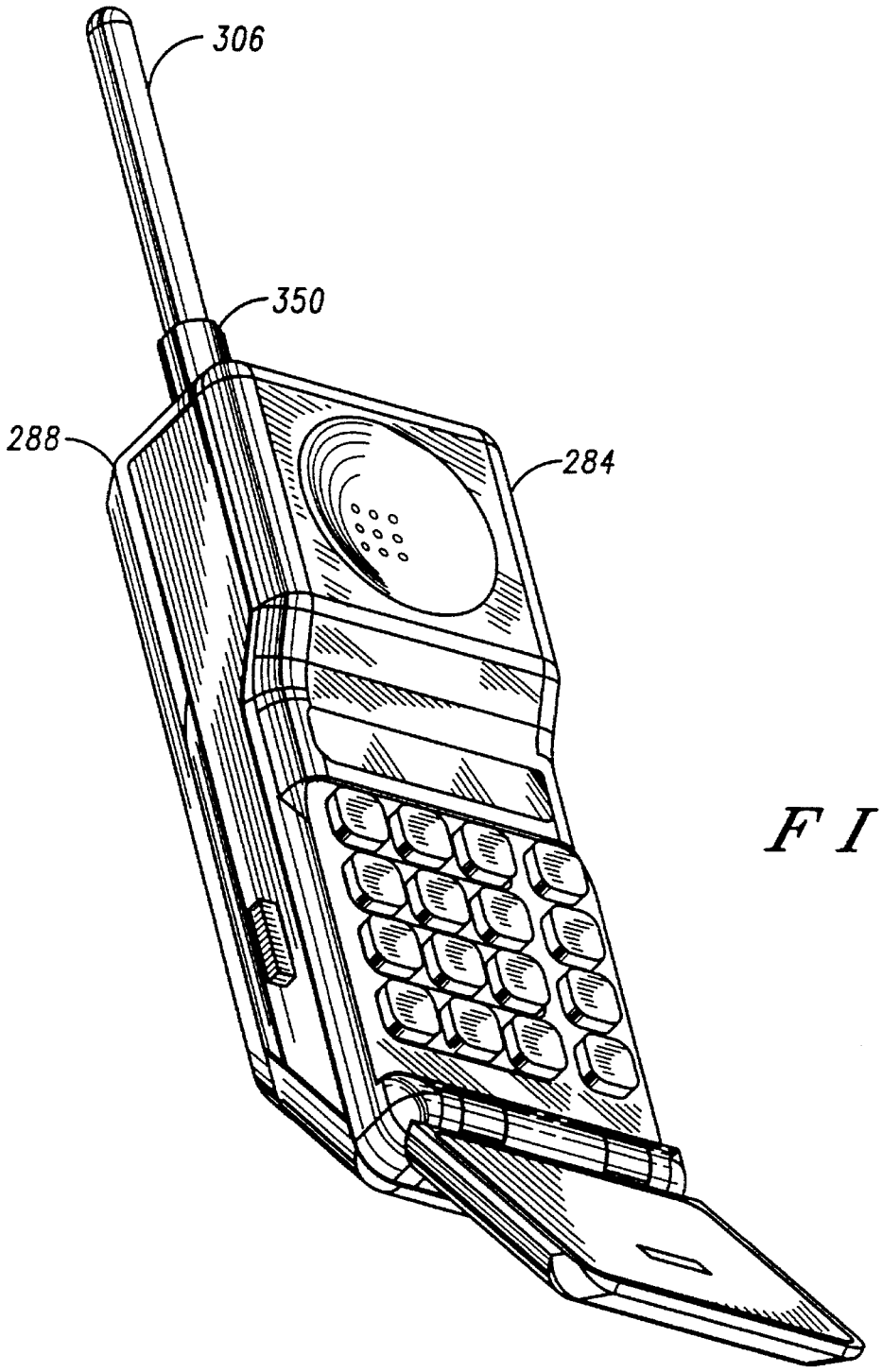
FIG. 10 is a perspective view of a radiotelephone of a preferred embodiment of the present invention.

FIG. 10 is a perspective view of radio transceiver 280 of FIGS. 6–9. Transceiver 280 again shown to be comprised of front and rear housing portions 284 and 288 to which an antenna assembly is attached. Antenna shaft 306 and a portion of support tube 350 extend beyond a top surface of front housing portion 284.

Figure 11:
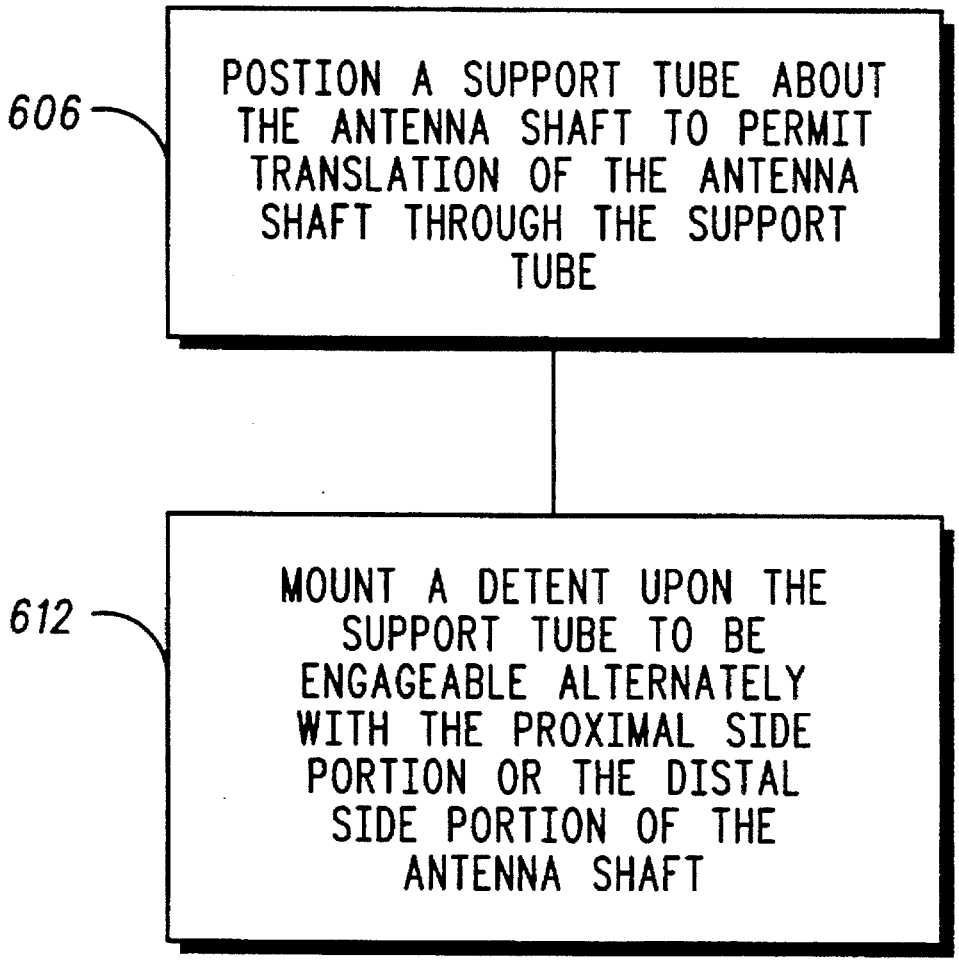
FIG. 11 is a flow diagram listing the method steps of the method of a preferred embodiment of the present invention.

Turning finally now to the logical flow diagram of FIG. 11, the method steps of a method, referred to generally by reference numeral 600, of a preferred embodiment of the present invention are listed. Method 600 is operative to translate an antenna shaft between a retracted position and a protracted position. First, and as indicated by block 606, a support tube is positioned about the antenna shaft. Next, and as indicated by block 606, a detent is mounted upon the support tube to be engageable alternately with a proximal side portion and a distal side portion of the antenna shaft, thereby to maintain positioning of the proximal side portion of the antenna shaft at the support tube or the distal side portion of the antenna shaft at the support tube.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An antenna assembly for a radio having radio circuitry, said antenna assembly comprising:

an antenna shaft defining a longitudinal axis and having a proximal side portion and a distal side portion;

a support tube positioned about the antenna shaft, said support tube having an inner diameter of dimensions permitting translation of the antenna shaft through the support tube to permit the support tube to be positioned about the proximal side portion of the antenna shaft or, alternately, to permit the support tube to be positioned about the distal side portion of the antenna shaft; and a detent mounted upon the support tube and engageable alternately with the proximal side portion and the distal side portion of the antenna shaft, thereby to maintain positioning of the proximal side portion of the antenna shaft at the support tube or the distal side portion of the antenna shaft at the support tube, respectively;

wherein the detent comprises a spring clip forming a U-shaped spring having a first spring arm and a second spring arm wherein the first and second spring arms are each engageable with the antenna shaft; and wherein the proximal-side portion of the antenna shaft comprises a proximal-side tapered mandrel portion of gradually-increasing diametral dimensions wherein translation of the antenna shaft through the support tube out of the position at which the distal side portion of the antenna shaft is positioned at the support tube and into the position at which the proximal side portion of the antenna shaft is positioned at the support tube causes expansive forces to be exerted upon the first and second spring arms of the spring clip as the proximal-side, tapered mandrel portion of the antenna shaft is translated through the support tube.

2. The antenna assembly of claim 1 further comprising at least a portion of a winding of a first antenna wire about the support tube wherein the first antenna wire is connectable to the radio circuitry of the radio.

3. The antenna assembly of claim 1 further comprising at least a portion of a winding of a second antenna wire about the antenna shaft.

4. The antenna assembly of claim 1 further comprising a notch formed upon the proximal-side, tapered mandrel portion, said notch of reduced diametral dimensions relative to diametral dimensions of the proximal-side tapered mandrel portion positioned adjacent thereto such that, when the antenna shaft is translated through the support tube to position the notch adjacent to the first and second spring arms of the spring clip, the first and second spring arms become positioned about the antenna shaft at the notch to maintain the antenna shaft in position thereat.

5. The antenna assembly of claim 1 further comprising a proximal-side stop positioned at an end of the proximal side portion of the antenna shaft for preventing translation of the antenna shaft beyond the support tube.

6. The antenna assembly of claim 5 further comprising a distal-side stop positioned along the distal side portion of the antenna shaft for preventing translation of the antenna shaft beyond the support tube.

7. The antenna assembly of claim 6 wherein said support tube comprises a tubular portion having a wall having a center aperture for permitting insertion of the antenna shaft therethrough.

8. The antenna assembly of claim 7 wherein said support tube further comprises a detent-support portion formed to extend beyond the bottom surface of the rear wall of the tubular portion of the support tube, said detent-support portion for supporting the detent therefrom.

9. The antenna assembly of claim 8 wherein the proximal-side stop seats against the detent-support portion of the support tube.

10. The antenna assembly of claim 7 wherein the distal side stop seats against the top surface of the rear wall of the tubular portion of the support tube.

11. An antenna assembly for a radio having radio circuitry, said antenna assembly comprising:

an antenna defining a longitudinal axis and having a proximal side portion and a distal portion;

a support tube positioned about the antenna shaft, said support tube having an inner diameter of dimensions permitting translation of the antenna shaft through the support tube to permit the support tube to be positioned about the proximal side portion of the antenna shaft or, alternately, to permit the support tube to be positioned about the distal side portion of the antenna shaft; and a detent mounted upon the support tube and engageable alternately with the proximal side portion and the distal side portion of the antenna shaft, thereby to maintain positioning of the proximal side portion of the antenna shaft at the support tube or the distal side portion of the antenna shaft at the support tube, respectively;

wherein the detent comprises a spring clip forming a U-shaped spring having a first spring arm and a second spring arm wherein the first and second spring arms are each engageable with the antenna shaft; and wherein the distal-side portion of the antenna shaft comprises a distal-side, tapered mandrel portion of gradually-increasing diametral dimensions wherein translation of the antenna shaft through the support tube out of the position at which the proximal side portion of the antenna shaft is positioned at the support tube and into the position at which the distal side portion of the antenna shaft is positioned at the support tube causes expansive forces toe exerted upon the first and second spring arms of the spring clip as the distal-side, tapered mandrel portion of the antenna shaft is translated through the support tube.

12. The antenna assembly of claim 11 further comprising a notch formed upon the distal-side, tapered mandrel portion, said notch of reduced diametral dimensions relative to diametral dimensions of the distal-side tapered mandrel portion positioned adjacent thereto such that, when the antenna shaft is translated through the support tube to position the notch adjacent to the first and second spring arms of the spring clip, the first and second spring arms become positioned about the antenna shaft at the notch to maintain the antenna shaft in position thereat.

* * * * *